US007091909B2

(12) United States Patent
Nakano et al.

(10) Patent No.: US 7,091,909 B2
(45) Date of Patent: Aug. 15, 2006

(54) ANTENNA UNIT ADAPTABLE TO A WIDEBAND

(75) Inventors: Hisamatsu Nakano, 4-6-7-101, Jousuiminami-cho, Kodaira-shi, Tokyo (JP); Akira Miyoshi, Tokyo (JP)

(73) Assignees: Mitsumi Electric Co., Ltd., Tokyo (JP); Hisamatsu Nakano, Kodaira (JP)

( * ) Notice: Subject to any disclaimer, the term of this patent is extended or adjusted under 35 U.S.C. 154(b) by 10 days.

(21) Appl. No.: 11/046,391

(22) Filed: Jan. 28, 2005

(65) Prior Publication Data

US 2005/0219127 A1 Oct. 6, 2005

(30) Foreign Application Priority Data

Apr. 2, 2004 (JP) ..... 2004-110212

(51) Int. Cl.
*H01Q 1/38* (2006.01)

(52) U.S. Cl. ..... 343/700 MS; 343/873

(58) Field of Classification Search ..... 343/700 MS, 343/873

See application file for complete search history.

(56) References Cited

U.S. PATENT DOCUMENTS 3,815,141 A * 6/1974 Kigler ..... 343/795
4,605,012 A * 8/1986 Ringeisen et al. ..... 607/155
5,995,047 A * 11/1999 Freyssinier et al. .. 343/700 MS

FOREIGN PATENT DOCUMENTS

JP 7-94934 A 4/1995
JP 10-190347 A 7/1998

* cited by examiner

*Primary Examiner*—Hoang V. Nguyen
(74) *Attorney, Agent, or Firm*—Frishauf, Holtz, Goodman & Chick, P.C.

(57) ABSTRACT

In a UWB antenna having an upper dielectric member, a lower dielectric member, and a conductor pattern interposed therebetween, the conductor pattern has a feeding point at a generally center portion of a front surface of the antenna. The conductor pattern further has an inverted triangular portion including a right tapered portion and a left tapered portion extending from the feeding point towards right and left side surfaces of the antenna, respectively. A main expanding portion expands from an upper side of the inverted triangular portion. A right expanding portion and a left expanding portion expand from the right and the left tapered portions of the inverted triangular portion, respectively.

6 Claims, 3 Drawing Sheets

ANTENNA UNIT ADAPTABLE TO A WIDEBAND

This application claims priority to prior Japanese patent application JP 2004-110212, the disclosure of which is incorporated herein by reference.

BACKGROUND OF THE INVENTION

This invention relates to an antenna unit and, in particular, to an antenna unit for an ultra wideband (UWB).

The UWB technology means an ultra wideband radio technology and is a broad term representative of a radio transmission system that occupies a bandwidth of at least 25% of a center frequency or a bandwidth wider than 1.5 GHz. Briefly speaking, the UWB technology is a revolutionary radio technology for carrying out communication using short pulses (typically having a pulse width of 1 ns or less) of an ultra wideband.

A key difference between the UWB technology and the traditional radio technology is presence or absence of a carrier wave. In the traditional radio technology, a sinusoidal wave having a certain frequency, called a carrier wave, is modulated in various manners to transmit and receive data. On the other hand, the UWB technology does not use the carrier wave but uses the short pulses of an ultra wideband as described above.

The traditional radio technology uses a narrow frequency band. This is because communication using a narrow frequency band allows an effective use of a radio wave which is a finite resource.

As understood by its name, the UWB technology uses an ultra wide frequency band. Nevertheless, the UWB technology occupying an ultra wideband attracts increasing attention. The reason resides in output energy at each frequency.

In the UWB technology, the frequency band is very wide but output power at each frequency is very low. Since the output power has a very low level below a noise level, an interference between UWB communication and other radio communications is extremely small.

On the other hand, the UWB communication extends over an ultra wideband which overlaps frequency bands of existing radio communication services. Therefore, the band for the UWB communication is limited to a range from 3.1 GHz to 10.6 GHz at present.

In the meanwhile, an antenna basically utilizes a resonance phenomenon. The antenna has a resonance frequency determined by its length. In the UWB communication including a number of frequency components, it is difficult to cause a resonance. As a frequency band of a radio wave to be transmitted is wider, it is increasingly difficult to design the antenna.

For example, a patch antenna is known as a compact antenna. As an example of the patch antenna, a compact flat patch antenna is disclosed, for example, in Japanese Unexamined Patent Application Publication (JP-A) No. H7-94934. The flat patch antenna is excellent in portability, high in frequency temperature characteristic, suppressed in variation of the resonance frequency, and excellent in reliability. A patch antenna unit adaptable to a plurality of frequencies is disclosed, for example, in Japanese Unexamined Patent Application Publication (JP-A) No. H10-190347.

However, the patch antenna does not cover a wideband and is therefore unsuitable for use as a UWB antenna.

In the meanwhile, TAIYO YUDEN CO., LTD., Tokyo, Japan has successfully developed a very small ceramic chip antenna for UWB which is recognized as a next-generation technology that will simultaneously achieve high-rate data transmission and low power consumption in the field of short-range radio communication. The ceramic chip antenna has a size of 10 mm×8 mm and a thickness as small as 1 mm. By the development of the ceramic chip antenna, the UWB technology traditionally limited to military applications is now released for commercial use, for example, high-speed connection of data between digital equipments such as a PDP (Plasma Display Panel) television and a digital camera. It is therefore possible to miniaturize various equipments, including mobile equipments.

Such a UWB antenna may be used for various applications such as Bluetooth (registered trademark) and wireless LAN (Local Area Network).

Bluetooth is an open standard for an advanced technology for realizing wireless data and voice communication in a relatively short range between desktop and notebook computers, PDAs (Personal Digital Assistants), mobile telephones, printers, scanners, digital cameras, and home electric appliances, and so on. Bluetooth is operable using a radio wave in a worldwide available 2.4 GHz band and, therefore, can be used throughout the world. Briefly speaking, use of Bluetooth makes it possible to connect digital peripheral devices without cables. Therefore, any trouble associated with cable connection is a matter of the past.

The wireless LAN is a LAN using a transmission path, such as a radio wave or an infrared ray, except a cable and a wire.

As described above, an existing antenna such as a patch antenna is disadvantageous in that it is difficult to cover a wideband and waveform distortion (waveform broadening or widening) occurs. Further, an antenna characteristic is excellent if a voltage standing wave ratio (VSWR) is as low as possible. However, the existing antenna can not lower the VSWR in a high-frequency range. In other words, the VSWR inevitably becomes high in a high-frequency range.

SUMMARY OF THE INVENTION

It is therefore an object of this invention to provide an antenna unit which can be used as a UWB antenna adaptable to a wideband.

It is another object of this invention to provide an antenna unit capable of improving frequency characteristics.

Other objects of the present invention will become clear as the description proceeds.

According to an aspect of the present invention, there is provided an antenna unit comprising an upper dielectric member, a lower dielectric member, and a conductor pattern interposed between the upper and the lower dielectric members, the conductor pattern having a feeding point at a generally center portion of a front surface of the antenna unit and comprising an inverted triangular portion having a right tapered portion and a left tapered portion extending from the feeding point towards a right side surface and a left side surface of the antenna unit with a predetermined angle, respectively, a main expanding portion expanding from an upper side of the inverted triangular portion, a right expanding portion expanding from the right tapered portion, and a left expanding portion expanding from the left tapered portion.

DESCRIPTION OF THE PREFERRED EMBODIMENT

Figure 1B:
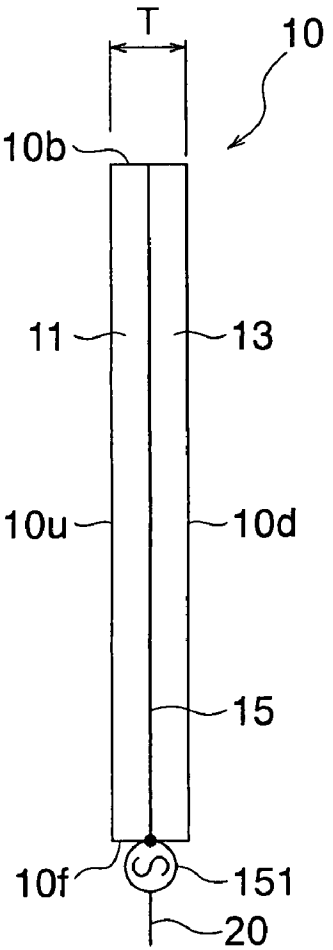
FIG. 1B is a vertical sectional side view of the UWB antenna illustrated in FIG. 1A.
Figure 1A:
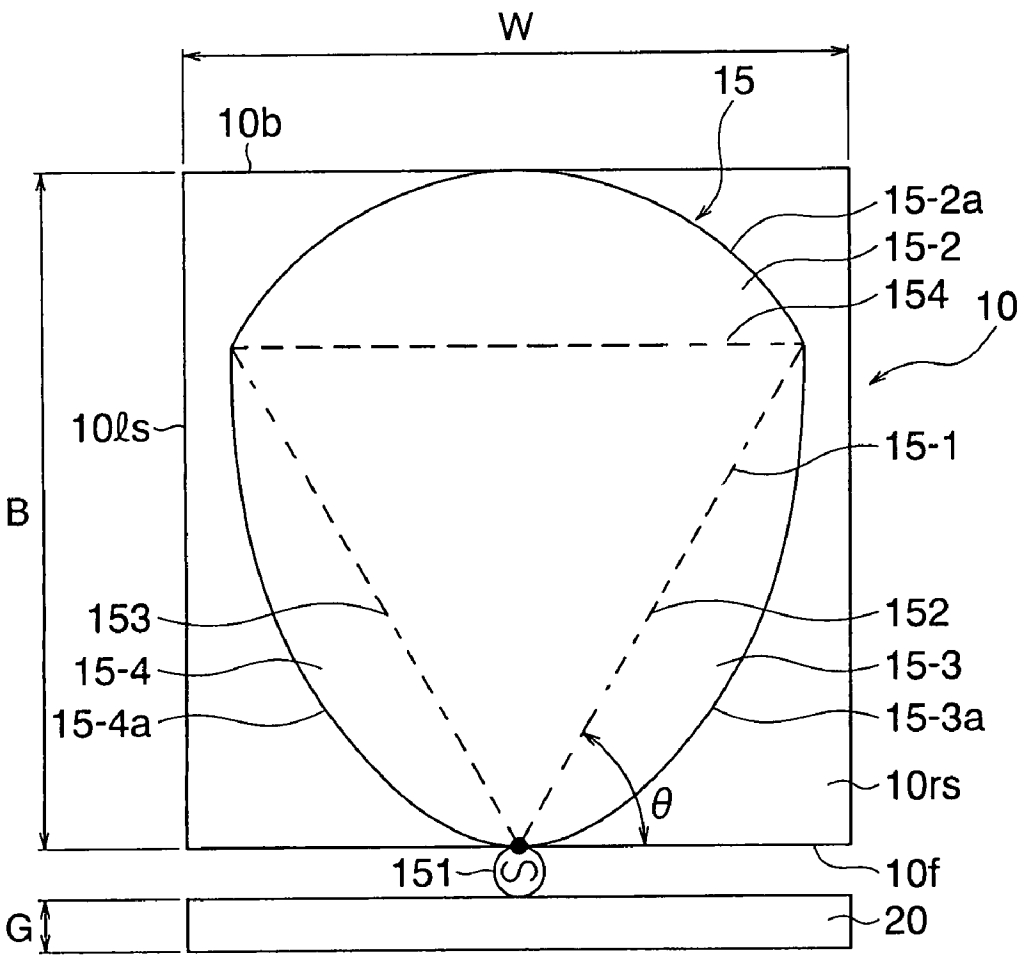
FIG. 1A is a horizontal sectional plan view of a UWB antenna as an antenna unit according to an embodiment of this invention.

Referring to FIGS. 1A and 1B, description will be made of a UWB antenna as an antenna unit according to an embodiment of this invention.

The UWB antenna depicted by a reference numeral 10 has, as a whole external appearance, a shape of a rectangular solid (rectangular plate) with a length B (in a vertical direction in FIG. 1A), a width W (in a horizontal direction in FIG. 1A), and a thickness T. In the illustrated example, the length B is equal to 10.1 mm, the width W is equal to 10.1 mm, and the thickness T is equal to 0.8 mm. The UWB antenna 10 has an uppersurface 10*u*, a bottom surface 10*d*, a front surface 10*f*, a back surface 10*b*, a right side surface 10*rs*, and a left side surface 10*ls*.

The UWB antenna 10 comprises an upper rectangular dielectric member 11, a lower rectangular dielectric member 13, and a conductor pattern 15 interposed between the upper and the lower rectangular dielectric members 11 and 13. Each of the upper and the lower rectangular dielectric members 11 and 13 has a length B, a width W, and a thickness T/2. The conductor pattern 15 is made of a material such as a silver paste and has a thickness of about 8 μm.

Each of the upper and the lower rectangular dielectric members 11 and 13 has a specific dielectric constant ∈r. In the illustrated example, the specific dielectric constant ∈r is equal to 4.4. For example, each of the upper and the lower rectangular dielectric members 11 and 13 comprises a ceramic plate.

The conductor pattern 15 has a feeding point 151 at a generally center portion of the front surface 10*f*. The feeding point 151 of the conductor pattern 15 is electrically connected to a ground member 20 having a length G and a width W. In the illustrated example, the length G is equal to 0.8 mm.

The conductor pattern 15 has an inverted triangular portion 15-1 having a right tapered portion 152 and a left tapered portion 153 extending from the feeding point 151 towards the right side surface 10*rs* and the left side surface 10*ls* with a predetermined angle θ, respectively, a main expanding portion 15-2 expanding from an upper side 154 of the inverted triangular portion 15-1, a right expanding portion 15-3 expanding from the right tapered portion 152, and a left expanding portion 15-4 expanding from the left tapered portion 153. The main expanding portion 15-2, the right expanding portion 15-3, and the left expanding portion 15-4 are integral with the inverted triangular portion 15-1. In the illustrated example, the predetermined angle θ is equal to 60°. Accordingly, the inverted triangular portion 15-1 is an equilateral triangle.

The main expanding portion 15-2 is defined by an arc 15-2*a* connecting opposite ends of the upper side 154 of the inverted triangular portion 15-1. Thus, the upper side 154 of the inverted triangular portion 15-1 is in closely contact with a base side of the main expanding portion 15-2. In other words, the upper side 154 serves as the base side of the main expanding portion 15-2. The arc 15-2*a* has a center coincident with centers of the length B and the width W.

The right and the left expanding portions 15-3 and 154 are defined by a smooth right curve 15-3*a* and a smooth left curve 154*a*, respectively. The right and the left curves 15-3*a* and 15-4*a* connect an apex of the inverted triangular portion 15-1 and the opposite ends of the upper side 154, respectively, and are symmetrical with each other.

In the above-mentioned UWB antenna 10, the conductor pattern 15 is interposed between the upper and the lower rectangular dielectric members 11 and 13. Further, the conductor pattern 15 has the feeding point 151 and the right and the left tapered portions 152 and 153 extending rightward and leftward from the feeding point 151 with the predetermined angle. Thus, the UWB antenna of a wideband can be obtained.

In addition to the main expanding portion 15-2 expanding from the upper side 154 of the inverted triangular portion 15-1, the conductor pattern 15 has the right and the left expanding portions 15-3 and 15-4 expanding from the right and the left tapered portions 152 and 153, respectively. Therefore, even in a high-frequency range, a low VSWR is maintained. It is consequently possible to further improve frequency characteristics.

Figure 2:
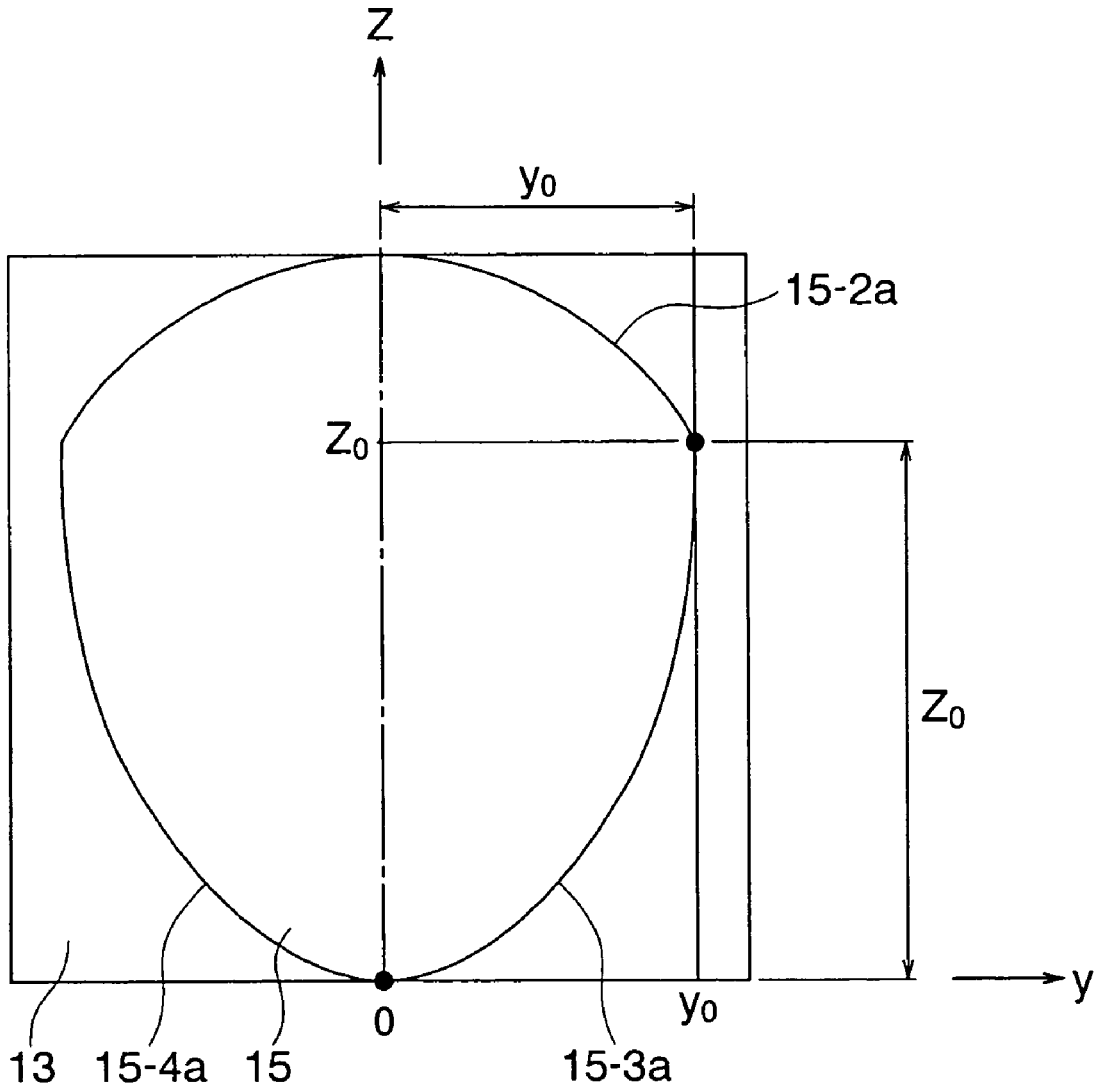
FIG. 2 is a view for describing a characteristic part of a shape of a conductor pattern of the UWB antenna illustrated in FIG. 1.

Referring to FIG. 2, the right curve 15-3*a* will be described more in detail. Herein, $z_0$ and $y_0$ are equal to 7.60 mm and 4.39 mm, respectively.

The following equation (1) is a general formula related to a curve. In conformity with FIG. 2, 1 is subtracted from $e^{az}$ so that y is equal to 0 when z is equal to 0.

$$e^{az}-1=y \tag{1}$$

From the equation (1), the following equation (2) for calculating a coefficient a is obtained.

$$a=ln(y_0+1)/z_0 \tag{2}$$

Substituting the above-mentioned values of $z_0$ and $y_0$ into the equation (2):

$$a=0.221651$$

Accordingly, a positive or plus (+) value of y (i.e., the value determining the right curve 15-3*a*) is obtained from the following equation (3).

$$y=y_0-\{e^{a(z0-z)}-1\} \tag{3}$$

Since the right and the left curves 15-3*a* and 15-4*a* are symmetrical with each other, a negative or minus (−) value of y (i.e., the value determining the left curve 15-4*a*) is similarly obtained.

Next referring to FIG. 3, description will be made of antenna characteristics of three types of UWB antennas.

Figure 3:
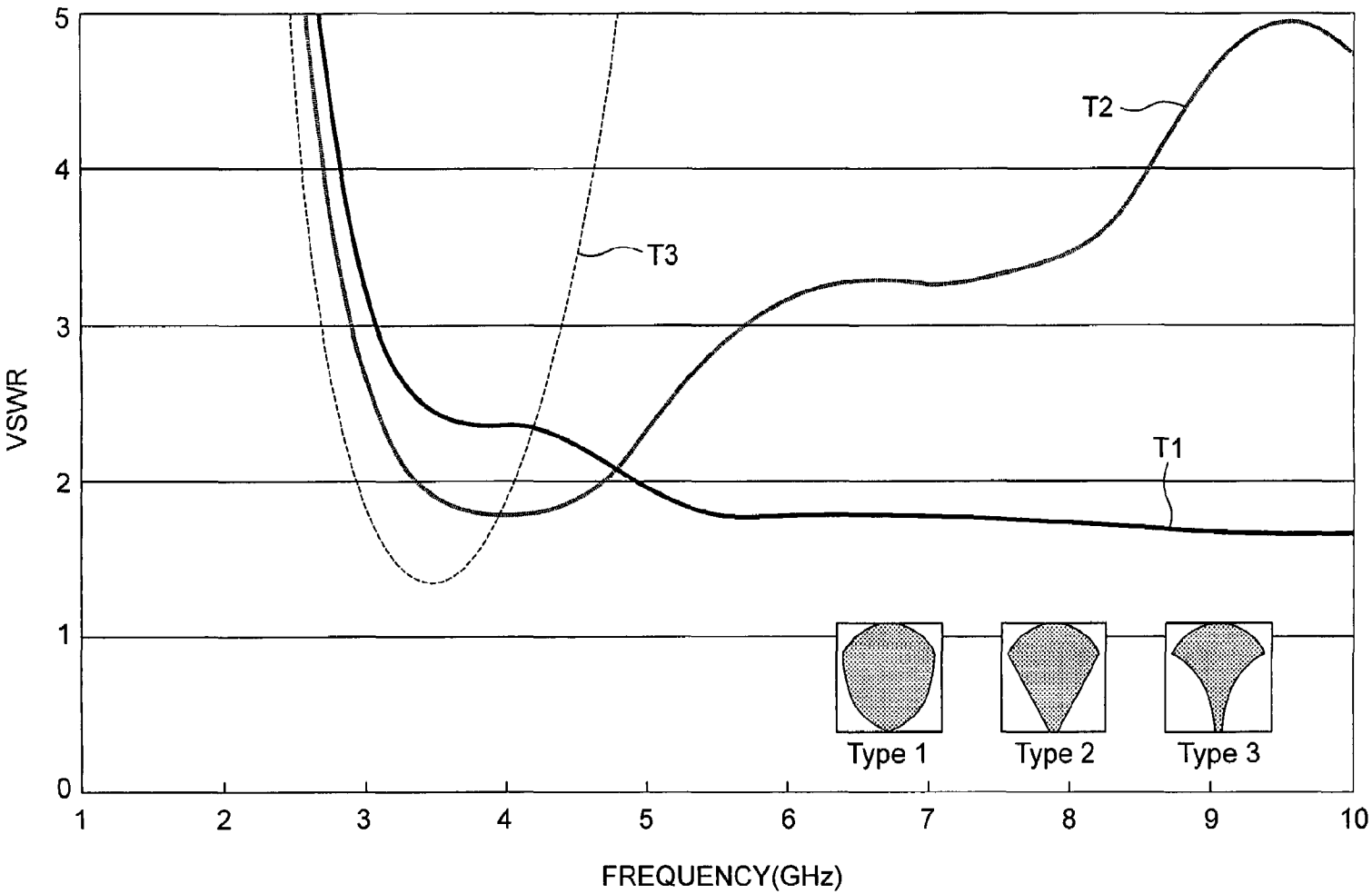
FIG. 3 is a view showing antenna characteristics of three kinds of UWB antennas.

In FIG. 3, an abscissa represents the frequency (GHz) while an ordinate represents the VSWR. In a right lower part of FIG. 3, three types of conductor patterns are shown. A lower VSWR represents a superior antenna characteristic.

A first characteristic curve T1 represents the antenna characteristic of an antenna having the conductor pattern 15 illustrated in FIG. 1, i.e., the first conductor pattern Type 1. A second characteristic curve T2 represents the antenna characteristic of the second conductor pattern Type 2. A third characteristic curve T3 represents the antenna characteristic of the third conductor pattern Type 3.

The first characteristic curve T1 has a low VSWR at a relatively high frequency, i.e., a frequency higher than about 5 GHz. Therefore, the antenna having the first conductor pattern Type 1 exhibits an excellent antenna characteristic. Thus, the UWB antenna illustrated in FIG. 1 is excellent in antenna characteristic.

The second characteristic curve T2 has a low VSWR only in a frequency range from about 3.5 to about 4.8 GHz but has a high VSWR at other frequencies. Thus, an antenna having the second conductor pattern Type 2 is inferior in antenna characteristic.

The third characteristic curve T3 has a low VSWR only in a frequency range from about 3 to about 4 GHz but has an extremely high VSWR at other frequencies. Thus, an antenna having the third conductor pattern Type 3 is also inferior in antenna characteristic.

While this invention has thus far been described in connection with the preferred embodiment thereof, it will be readily possible for those skilled in the art to put this invention into practice in various other manners without departing from the scope set forth in the appended claims.

What is claimed is:

1. An antenna unit comprising an upper dielectric member, a lower dielectric member, and a conductor pattern interposed between the upper and the lower dielectric members, the conductor pattern having a feeding point at a generally center portion of a front surface of the antenna unit and comprising:

an inverted triangular portion having a right tapered portion and a left tapered portion extending from the feeding point towards a right side surface and a left side surface of the antenna unit with a predetermined angle, respectively;

a main expanding portion expanding from an upper side of the inverted triangular portion;

a right expanding portion expanding from the right tapered portion; and a left expanding portion expanding from the left tapered portion.

2. The antenna unit according to claim 1, wherein the right and the left expanding portions are defined by two smooth curves, respectively.

3. The antenna unit according to claim 2, wherein the two smooth curves connect an apex of the inverted triangular portion and opposite ends of the upper side, respectively.

4. The antenna unit according to claim 2, wherein the two smooth curves are symmetrical with each other.

5. The antenna unit according to claim 1, wherein the inverted triangular portion is an equilateral triangle.

6. The antenna unit according to claim 1, wherein the main expanding portion is defined by an arc connecting opposite ends of an upper side of the inverted triangular portion.

* * * * *